US006564802B1

(12) United States Patent
Kraeft, Sr.

(10) Patent No.: US 6,564,802 B1
(45) Date of Patent: May 20, 2003

(54) SUPPORT FOR A DISABLED GOLFER

(76) Inventor: Robert W. Kraeft, Sr., 10581 E. Dorado Ave., Englewood, CO (US) 80111

( * ) Notice: Subject to any disclaimer, the term of this patent is extended or adjusted under 35 U.S.C. 154(b) by 0 days.

(21) Appl. No.: 10/014,910

(22) Filed: Dec. 14, 2001

(51) Int. Cl.[7] ..... A61G 15/00
(52) U.S. Cl. ..... 128/845; 602/19; 180/65.1
(58) Field of Search ..... 128/845, 846, 128/869, 876; 602/19; 180/65.1, 907, 6.5

(56) References Cited

U.S. PATENT DOCUMENTS

| | | | |
|---|---|---|---|
| 2,822,969 | A | 2/1958 | Cooper |
| 3,708,182 | A | 1/1973 | Markiel |
| 3,926,448 | A | 12/1975 | Reichard |
| 4,270,721 | A | 6/1981 | Mainor, Jr. |
| 5,307,889 | A | 5/1994 | Bohannan |
| 5,346,028 | A | 9/1994 | Cassano |
| 5,569,167 | A | 10/1996 | Friedli |
| 5,727,642 | A | 3/1998 | Abbott |

FOREIGN PATENT DOCUMENTS

| | | |
|---|---|---|
| WO | WO 86/00054 | 1/1986 |

*Primary Examiner*—Michael A. Brown
(74) *Attorney, Agent, or Firm*—Richard C. Litman

(57) ABSTRACT

A support for a disabled golfer removably attaches to a conventional golf cart without requiring modification to the cart, and provides support for a golfer during a golf swing. The present support essentially comprises a pair of telescoping tubes, with one end of an outer tube being pivotally clamped to one of the roof support uprights of the golf cart and the opposite end of the outer tube being retained within a guard clamped to the opposite roof support upright to allow limited vertical movement of the assembly for variations in golfer height, terrain, etc. An extension tube telescopes from the outer tube, and a support belt is removably attached to the distal end of the extension tube. The golfer need only position the cart as desired, extend the support as needed, and secure himself or herself using the belt for support during the golf swing.

19 Claims, 7 Drawing Sheets

SUPPORT FOR A DISABLED GOLFER

BACKGROUND OF THE INVENTION

1. Field of the Invention

The present invention relates generally to orthopedic braces, supports, and the like, and more particularly to a device which may be temporarily secured to the conventional roof supports of a golf cart to assist in supporting a physically disabled golfer during his or her swing. The present support is relatively lightweight and compact in its stored configuration, and is easily installed upon and removed from the golf cart to enable the disabled golfer to install the device temporarily upon any conventional golf cart as desired. Alternatively, a club or other organization may equip one or more carts with the present support in order to provide such specially equipped carts to physically handicapped golfers, as desired.

2. Description of the Related Art

Golf is an activity enjoyed by ever increasing numbers of people throughout the world. Many people become involved in the game at a relatively young age, and continue to play throughout their lives. The game is not particularly demanding in the physical sense, and requires only normal health and conditioning for the golfer to be able to play reasonably well.

While the undemanding physical nature of the game may be seen as an advantage to many fans of the game, it can be frustrating for the older or physically disabled golfer who was able to play the game for most his or her life, but has later encountered physical disabilities which hamper his or her ability to play. In many more vigorous sports and activities, this might be accepted as a part of life, but since golf is such a relatively undemanding physical activity, and moreover enables the golfer to enjoy the outdoors and also serves as a social activity, many physically handicapped golfers are justifiably frustrated that they can no longer enjoy what in many cases was a life long activity for them.

Some physically handicapped golfers have made some attempts to continue playing the game by arranging for another person or player to assist in supporting them during each golf swing, or alternatively bracing themselves upon the fender of a golf cart. Such makeshift solutions are not satisfactory. Being held by another person is distracting to the golfer to say the least, and such support is not at all steady or secure in most instances, particularly as the golfer is moving through his or her golf swing. While a golf cart may provide more steady and secure support, the structure of the cart often interferes with the golfer's swing, particularly on longer shots with greater back swings.

Accordingly, a need will be seen for a support for a physically disabled golfer, which support may be removably secured to the roof supports of a conventional golf cart for supporting the golfer in turn. The present golfer support essentially comprises a telescoping tubular structure which removably clamps laterally across the two forward (or rear) uprights supporting the roof of a conventional golf cart. One portion of the support is laterally extendible from the other, and includes a removably attachable belt or harness extending from its distal end. Some accommodation is also provided in the attachment system, to provide some vertical play in the distal belt or harness end for golfers of different heights and for slight differences in terrain, etc.

The golfer merely positions the golf cart as desired for a given shot, extends the distal arm as required, applies the support belt around his or her waist, and makes the golf stroke. The lateral adjustment of the extendible portion, along with the accommodation of the belt attachment to the distal end of the extension arm, allow the golfer to adjust his or her position slightly as desired. The golfer may make the golf stroke with complete confidence that such physical handicaps as difficulty in maintaining balance, difficulty in supporting one's weight, etc., will not cause the golfer to fall. Once the golf shot has been made, the golfer need only release the support belt from around his or her waist, retract the extension arm, and return to the golf cart to travel to the next shot to continue play.

A discussion of the related art of which the present inventor is aware, and its differences and distinctions from the present invention, is provided below.

U.S. Pat. No. 2,822,969 issued on Feb. 11, 1958 to Wayne L. Cooper, titled "Golf Bag Locating And Retaining Carrier Means For Vehicles," describes a brace which is permanently installed in the back of a golf cart, for supporting a pair of golf bags therein. The device includes a base plate with a flange which is attached to the golf cart by self tapping screws or the like, for an essentially permanent installation. A pair of opposed upright arms are provided, with each arm having an adjustable loop or belt thereon for securing about a golf bag. The Cooper device cannot be temporarily secured to and removed from the golf cart; its arms cannot be disposed horizontally to support a person at some distance from the cart; and the golf bag support loops cannot be adjusted to support a golfer standing away from the cart.

U.S. Pat. No. 3,708,182 issued on Jan. 2, 1973 to Henry Markiel, titled "Combination Wheel Chair And Walker," describes an attachment for a conventional wheel chair, comprising an inverted, generally U-shaped frame which clamps removably to the front legs of the wheel chair. A forwardly disposed stabilizing brace and wheel extends from the upper center of the frame. The device provides support for a person who wishes to get some walking exercise, but who otherwise uses the wheel chair. The Markiel walker has no telescoping arm to support a person away from the chair, nor does it provide any waist belt support.

U.S. Pat. No. 3,926,448 issued on Dec. 16, 1975 to Kenneth Reichard, titled "Golf Cart Pulling Apparatus," describes a manually propelled golf cart with an extension for securing about the waist of a person for pulling the cart. The telescopic arm which connects the waist belt to the cart, attaches to the cart at a low point between the two forward wheels and extends upwardly therefrom, rather than securing horizontally across the cart structure at approximately waist height, as does the present golfer support. The Reichard device teaches away from the present golfer support, as Reichard is interested in providing means for the golfer to propel the cart using a waist belt, rather than providing a device to allow the cart to support the golfer, as in the present physically disabled golfer support invention.

U.S. Pat. No. 4,270,721 issued on Jun. 2, 1981 to Ross F. Mainor, Jr., titled "Instrument Support," describes a telescoping cantilever arm for removably clamping to another structure. The unsupported distal end of the device includes a cylindrical socket for temporarily holding a surveying instrument. No adjustment of the socket is provided, and it cannot be adapted to fit about the waist of a person. The Mainor, Jr. support teaches away from the present support in that no articulation of the instrument support socket or the support arm are provided, nor is such articulation desirable in an instrument support, which must provide a rigid mounting for the instrument. In contrast, the present golfer support provides vertical articulation for the extended distal end of the device, as well as articulation for the belt attachment.

U.S. Pat. No. 5,307,889 issued on May 3, 1994 to William D. Bohannon, titled "Portable Golf Cart," describes a small, tricycle cart having a single seat with an upright stanchion for securing a golf bag thereto. The stanchion includes a pair of semicircular collar sections and straps for securing about the golf bag. However, no articulation of the rigidly attached collar sections is provided, and in any event, the collars and straps are not adapted to fit about the waist of a golfer to support him or her during play, as provided by the present invention. The Bohannon stanchion is not horizontally cantilevered from the cart to support a golfer standing upon the underlying surface, as is the present support. Even if the Bohannon golf bag straps could be used to secure about a golfer, the golfer would have to stand upon the floor of the golf cart, as the stanchion does not extend laterally past the cart.

U.S. Pat. No. 5,346,028 issued on Sep. 13, 1994 to Nicola Cassano, titled "Golf Cart With Adjustable Steering Assembly," describes a small motorized cart for the carriage of a single person and one golf bag. A tiller type steering system is used for the single steerable front wheel, with the shaft of the tiller telescoping for extension to the rear so the golfer may walk behind the cart and steer, if so desired, rather than being required to remain in the seat. However, the steering tiller is incapable of supporting the golfer during play, as it is pivotally attached to the steering axis of the front wheel and is not self-supporting, nor can it support any other loads. Moreover, no means is provided for securing the device about the waist of a golfer.

U.S. Pat. No. 5,569,167 issued on Oct. 29, 1996 to Faye E. Friedli, titled "Rehabilitation Apparatus In Combination With A Motor-Driven Vehicle," describes an assembly for attachment to a golf cart or the like. The Friedli apparatus attaches differently and at a different height than the present support, and does not provide passive support for the person (s) using the device. The Friedli assembly requires an upper tube which is apparently permanently attached to the roof of the vehicle; Friedli makes no mention of its removability or any specific attachment means. A first laterally disposed bar is then inserted into the roof mounted tube, with the lateral bar having a vertically depending leg. A second lateral bar is adjustably positioned along the vertical leg of the first lateral bar, "at approximately shoulder height" (column 4, line 13). Persons undergoing rehabilitation then grasp the second lateral bar and walk while holding the bar as the vehicle is driven slowly. The Friedli bar is rigidly installed upon the vehicle, unlike the articulation provided for the present support through a limited vertical arc. Moreover, the Friedli assembly teaches away from the present golfer support, in that it requires persons to grip the bar actively, rather than providing passive support, as is provided by the present golfer support. The Friedli apparatus could not be used to provide support for a golfer during play, as the golfer must be able to use both hands to grip and swing a golf club and cannot grip a bar for support during the swing. Finally, the Friedli apparatus cannot be used with a rental cart, due to the need for permanent installation of the roof bar.

U.S. Pat. No. 5,727,642 issued on Mar. 17, 1998 to Emerson L. Abbott, titled "Golf Cart," describes a small, single seat golf cart for use by a physically handicapped player. The seat may be swiveled through 360 degrees, the steering column may be swung forwardly, and the golf bag rack secured to the rear of the cart may be tilted to clear the arc of the golfer's swing. The Abbott cart is used by swiveling the seat to the desired side, tilting the steering column forwardly, and tilting the golf bag rack with its golf bag to one side, in order for the golfer to make his or her golf swing from a sitting position in the seat of the cart. The Abbott cart cannot provide for the attachment of a separate, generally horizontal, cantilever arm for supporting a standing golfer about the waist, as provided by the present invention.

Finally, PCT Patent Publication No. 86/00054 published on Jan. 3, 1986 to Jean-Claude Desplanques, titled "Two-Wheel Carriage Pulled By A Person By Means Of A Flexible Pole," describes (according to the drawings and English abstract) a small, low, wheeled platform having a flexible handlebar or shaft extending therefrom with a waist attachment belt at its distal end. The Desplanques device cannot provide cantilever support for an object extending therefrom, as (1) only two wheels are provided, and any attempt to support a weight forwardly or rearwardly from the cart will cause the cart to tip, and (2) the pole used to pull the cart is flexible and cannot support a significant mass.

None of the above inventions and patents, either singly or in combination, is seen to describe the instant invention as claimed.

SUMMARY OF THE INVENTION

The present invention is a support for temporary and removable attachment to the conventional roof support members of a golf cart. The present support provides assistance in standing for a physically disabled golfer, who otherwise would have trouble supporting himself or herself while making a golf swing. The present support removably clamps to the two upright roof support forward members of a conventional golf cart, and extends laterally thereacross. No modification of the golf cart structure is required for installation of the present support.

The support includes a telescoping arm with a support belt secured removably to its distal end. One end of the arm is secured pivotally to a clamp which attaches removably to one roof support upright, while the opposite end of the arm is captured within a similarly attached bracket allowing limited movement in a vertical arc to accommodate variations in the height of different golfers, terrain variation, etc. The extension member with its belt attached to the distal end, extends from this end of the assembly.

The golfer positions the cart near the golf ball, leaves the cart and extends the extension arm to its fully extended and positively locked position to position the distal end adjacent the ball. The golfer may use the extension arm as a support while positioning himself or herself at the distal end as desired. The golfer then secures the support belt around his or her waist. (It may be necessary to relax the rules to allow the golfer to relocate the ball slightly, as the golfer cannot reposition himself or herself while secured by the support.) The golfer may then make the golf swing without fear of falling due to loss of balance or leg strength, etc. The apparatus may be used for support as the golfer returns to the cart after making the swing.

Accordingly, it is a principal object of the invention to provide a support for a physically disabled golfer, which support is removably attachable to the structure of a conventional golf cart without modification to the golf cart.

It is another object of the invention to provide such a support having a telescoping extension component, for providing cantilever support of the golfer at some distance from the cart in order to provide clearance for the golfer's swing from the cart.

It is a further object of the invention to provide such a support including a support belt removably securable about the waist of the golfer.

Still another object of the invention is to provide such a support including limited articulation through a vertical arc, to accommodate variations in the height of the golfer and in the terrain, etc.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a device for supporting a physically disabled golfer during play. The present disabled golfer support removably attaches to a golf cart, with no requirement for modification (bolt attachment holes, etc.) to the cart. Thus, the support may be purchased by a physically disabled golfer who has need of such a device, and transported to the course to be played, along with golf clubs and/or any other equipment desired. Upon arrival at the course, and rental of a golf cart, the present support is temporarily secured to the cart to provide support to the golfer during play. The device is easily removed from the cart at the end of the round of golf, for the golfer to take home along with his or her clubs and/or other equipment.

Figure 1:
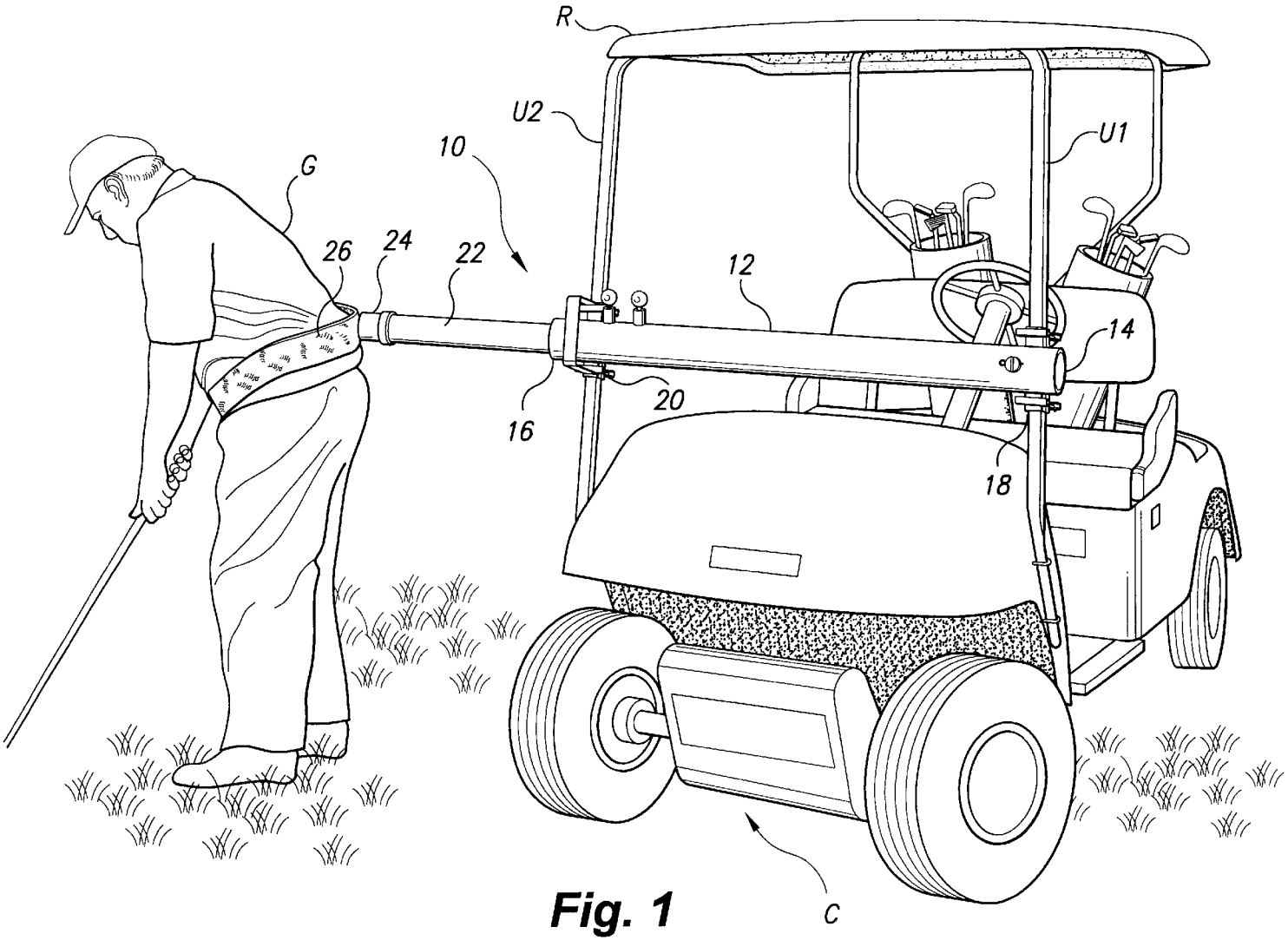
FIG. 1 is an environmental, perspective view of the present, support for a disabled golfer installed upon a golf cart, showing its use according to the present invention.

FIG. 1 provides a perspective view showing the general features and operation of the present golfer support, indicated by the reference numeral 10 throughout the drawings. The support 10 requires a conventional golf cart C for use, with the golf cart C having at least a pair of opposed roof support uprights U1 and U2 for supporting the roof R of the cart C. While the present support 10 is illustrated as being secured to the two front uprights U1 and U2, it will be noted that it may be secured to the two rear roof support uprights, or even across the uprights along either side of the cart C, if so desired. However, it will generally be easier for the golfer to position the device when it is secured laterally across the two forward uprights U1 and U2 immediately in front of the golfer as he or she operates the cart C.

The disabled golfer support 10 includes a rigid, elongate support member 12 having a first end 14 and an opposite second end 16. The support member 12 is secured to the two uprights U1 and U2 by respective first and second roof support clamp assemblies 18 and 20, secured to or about the respective ends 14 and 16 of the support member 12. The clamp assemblies 18 and 20 are described in detail further below, and provide for the removable attachment of the support member 12 and other components of the present support 10 to the golf cart C structure without requiring modification of the cart C structure, as noted above.

A rigid extension arm 22 extends from the second end 16 of the base support member 12, and slides or telescopes into the support member 12 for compact storage and extends outwardly therefrom in a cantilever configuration for use in supporting a physically disabled golfer G, generally as shown in FIG. 1. The extension arm 22 includes a distal golfer support end 24 generally opposite the support member 12 when the extension arm 22 is extended for use, with a belt 26 providing passive support for the disabled golfer G removably secured to the golfer support end 24 of the extension arm 22. The support member 12 and extension arm 22 are preferably each formed of hollow tubular components, and may make use of various composite materials (glass and/or carbon fiber resin, etc.), plastics, metals (aluminum, etc.) in their construction, as desired. Preferably, composite materials or plastics are used, in order to provide light weight, corrosion resistance, and the desired strength and ductility.

Figure 2:
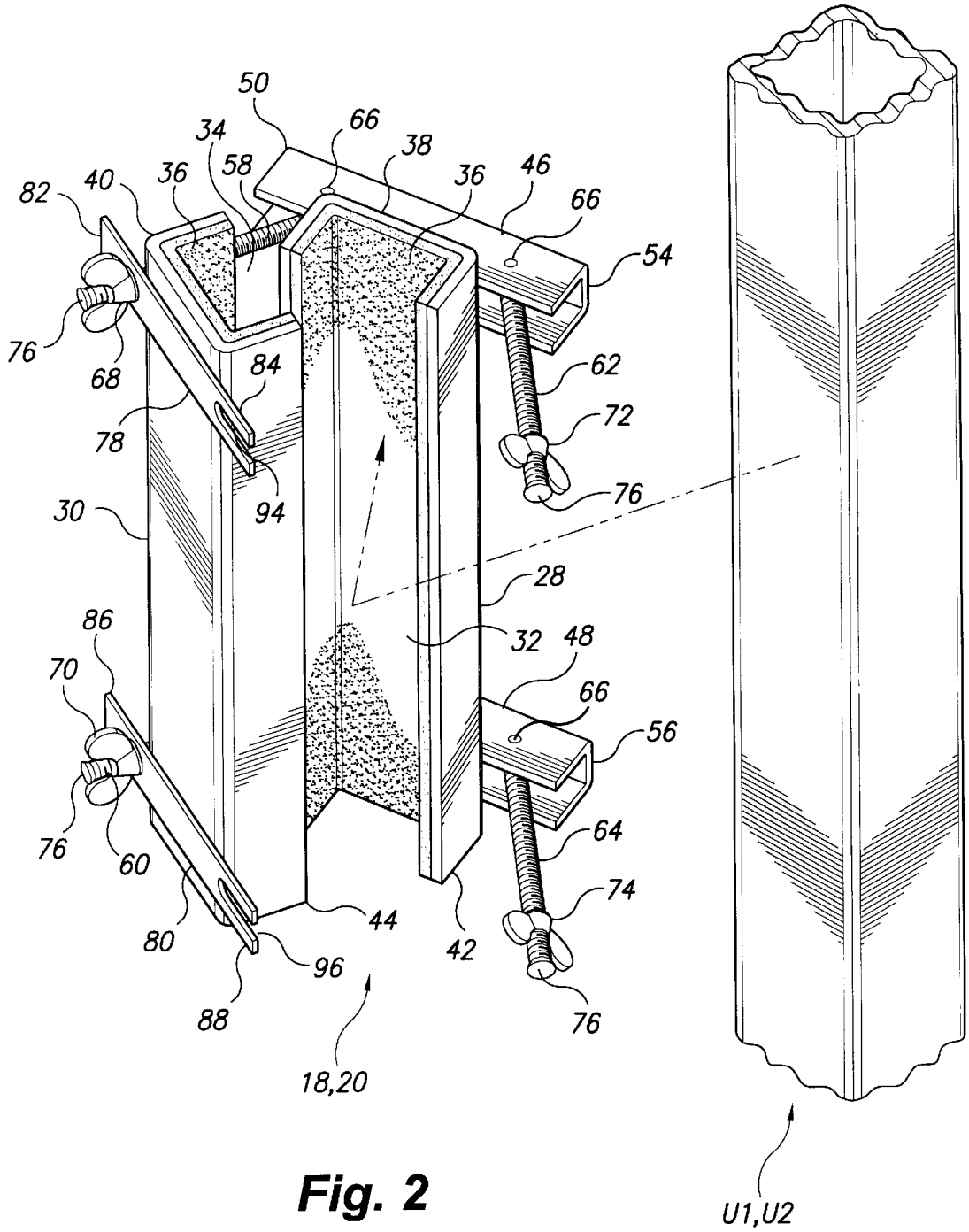
FIG. 2 is a perspective view of an opened clamp assembly, showing its removable attachment to one of the roof support uprights of a golf cart.

FIG. 2 provides a detailed illustration of one of the roof support clamps which secure to the roof support uprights of the golf cart C. It will be noted that the clamp shown in FIG. 2 has additional componentry for attaching the clamp to the support member 12, which is not shown in FIG. 2 for clarity in the drawing. It will be noted that the componentry for attaching the first and second clamps 18 and 20 to the respective ends 14 and 16 of the support member 12 (shown in FIGS. 3 and 6) is the only factor differentiating the two clamps 18 and 20 from one another, and is described below. Thus, FIG. 2 shows only the common features of the clamps 18 and 20. In the same manner, the two roof support uprights are essentially identical to one another, with the exemplary upright shown in FIG. 2 designated as upright U1, U2.

The support member attachment clamp 18, 20 includes opposed first and second channels, respectively 28 and 30, which are connected together generally along one side thereof and which open to secure about the roof support member U1, U2. The two channels 28 and 30 have mutually facing interior portions 32 and 34 which are preferably formed to fit closely about the specific shape of the roof support upright U1, U2, e. g., rectangular channels 28 and 30 for square or rectangular roof support uprights U1, U2, etc. The interior portions 32 and 34 are preferably padded with a resilient liner 36 in order to preclude marring the surface of the uprights U1, U2 when the clamps 18, 20 are installed thereon.

Figure 3:
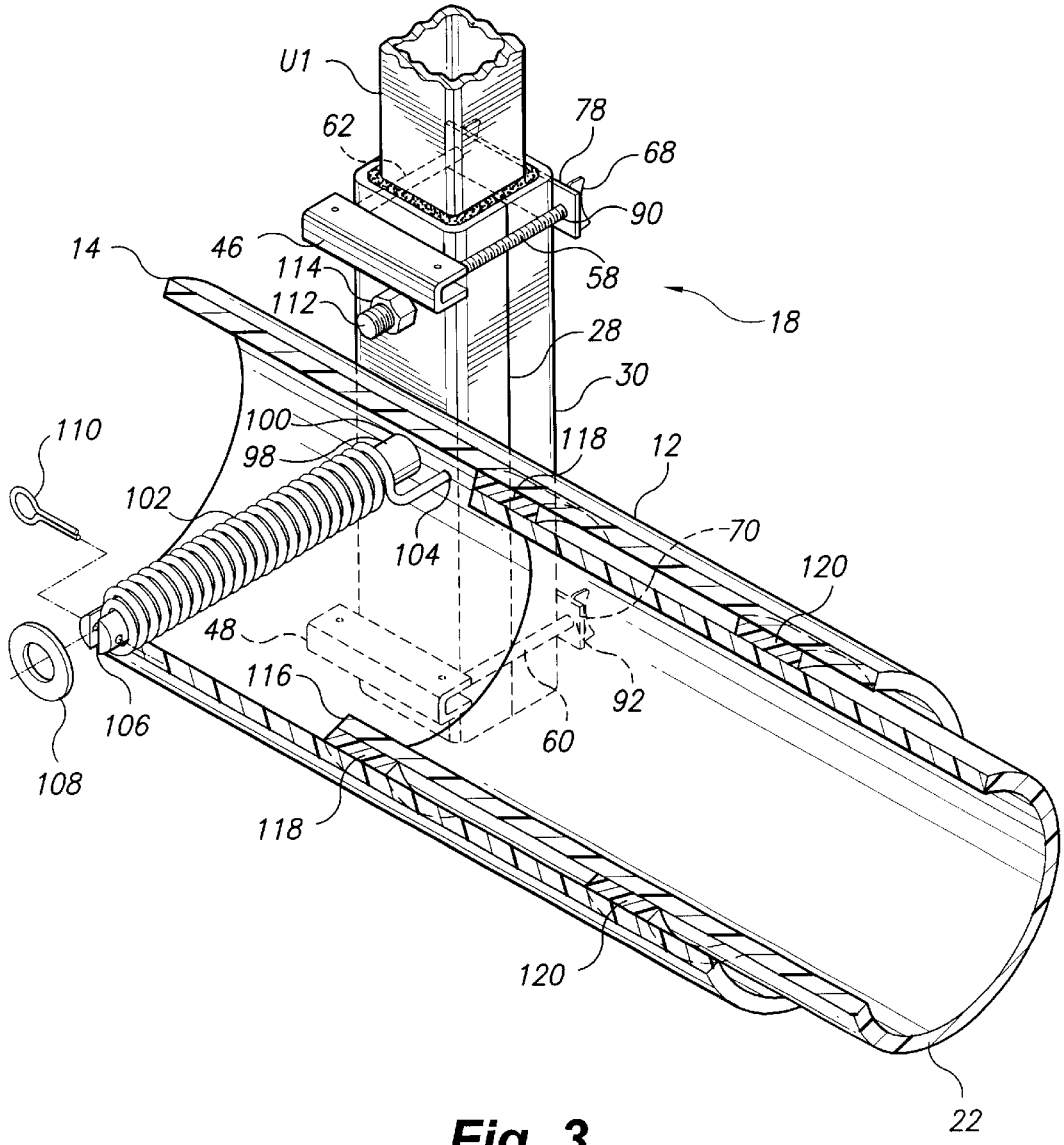
FIG. 3 is a broken away perspective view of the pivot attachment end of the support tube, showing details thereof.
Figure 6:
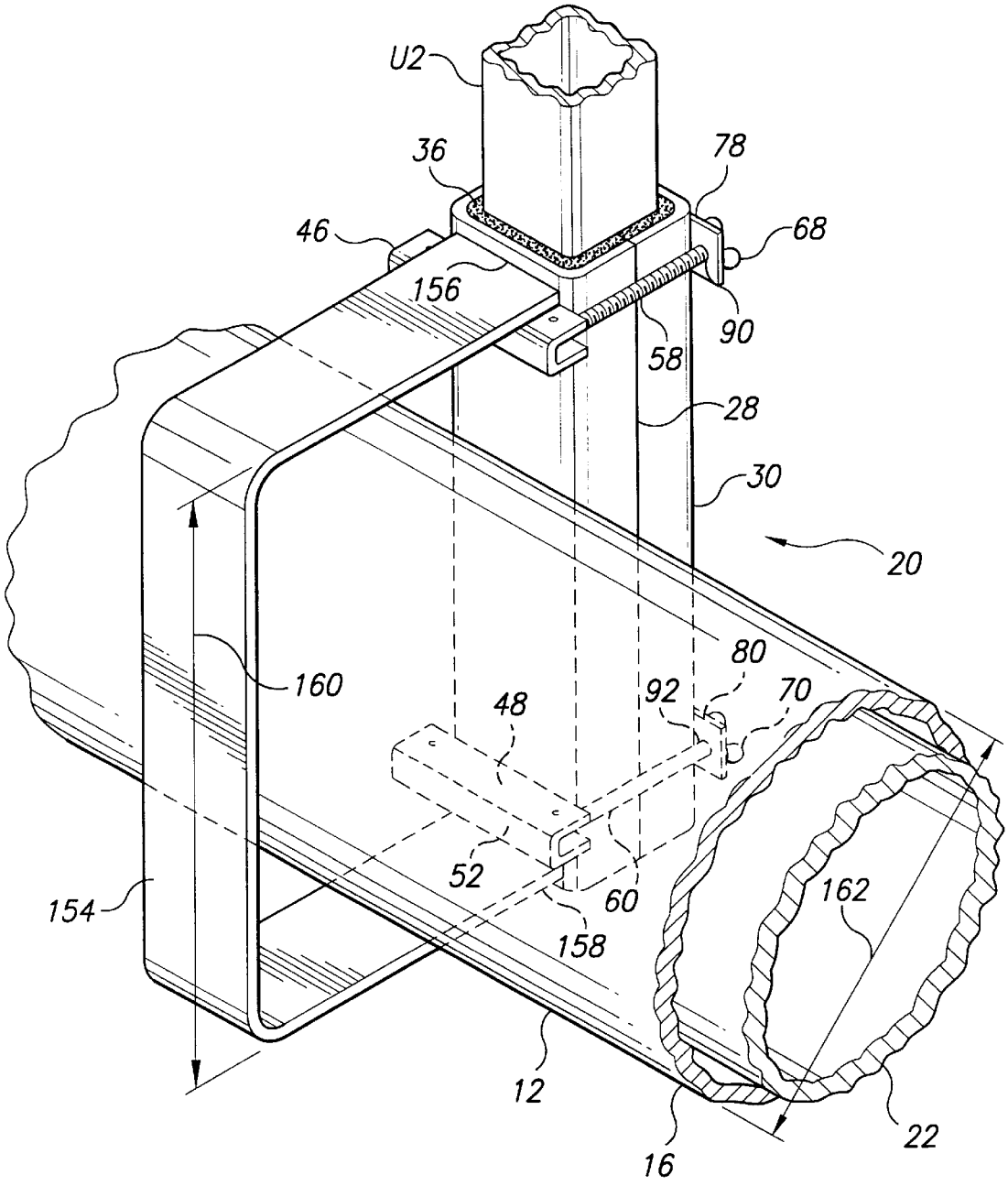
FIG. 6 is a broken away perspective view of the retaining guard and its roof support clamp attachment and telescoping support tubes, showing further details thereof.

Each clamp channel 28 and 30 has a first end, respectively 38 and 40, and opposite second end, respectively 42 and 44. A first crossmember 46 is secured across the first end 38 of the first channel 28, and a second crossmember 48 across the opposite second end 42 of the first channel 28. Each of these two crossmembers 46 and 48 has a first end, respectively 50 and 52, and an opposite second end, respectively 54 and 56; the first end 52 of the second crossmember 48 is shown in FIGS. 3 and 6. Each crossmember end 50 through 56 has a threaded fastener, respectively 58, 60, 62 and 64, extending therefrom and secured thereto by a pivot pin 66. These fasteners 58, 60, 62 and 64 each have a cooperatively threaded nut (e.g. a hand manipulable wing nut, as shown), respectively 68, 70, 72 and 74, captured thereon. The distal ends 76 of the threaded fasteners 58 through 64 are peened or otherwise modified to preclude removal of their respective nuts 68 through 74 therefrom.

The second channel 30 includes first and second fastener attachment plates, respectively 78 and 80, secured across the respective first and second ends 40 and 44 thereof. The first attachment plate 78 has opposite first and second ends, respectively 82 and 84, with the second plate 80 having opposite first and second ends 86 and 88. The attachment plate first ends 82 and 86 have respective fastener passages 90 and 92 therethrough (shown in FIGS. 3 and 6), with the respective fasteners 58 and 60 being permanently captured therethrough, with the attachment plate second ends 84 and 88 having respective lateral slots 94 and 96 therein to allow selective removal of the fasteners 62 and 64.

The above described structure assures that all of the above componentry and hardware remains attached to the clamps at all times, thus precluding loss of any fasteners or other relatively small components. The clamps 18 and 20 are temporarily and removably secured to their respective roof support uprights U1 and U2 of the golf cart C by opening the two clamp channel portions 28 and 30, generally as shown in FIG. 2, and passing them around their respective uprights U1 and U2. The two nuts 72 and 74 of the third and fourth fasteners 62 and 64 are loosened as required, and the third and fourth fasteners 62 and 64 extending from the second ends 54 and 56 of the crossmembers 46 and 48, are pivoted to place their distal ends within the respective slots 94 and 96 of the opposite attachment plates 78 and 80. All four nuts 68 through 74 are then tightened evenly as required to clamp the channel portions 28 and 30 securely to their respective uprights U1 and U2. The procedure is reversed for removing the clamps 18 and 20 and their attached support member 12 and its structure from the uprights U1 and U2.

FIG. 3 illustrates the pivotal attachment of the first end 14 of the support member tube 12 to the first clamp assembly 18. A pivot pin 98 is immovably affixed (welded, etc.) to the first channel 28 of the first clamp 18, and extends outwardly therefrom. A pair of pivot pin passages or holes 100 (one of which is shown in the broken away view of FIG. 3) are formed diametrically through the first end 14 of the support member tube 12, with the pivot pin 98 passing through these holes 100 to secure the first end 14 of the tube 12 to the first clamp assembly 18.

A balance spring 102 is placed concentrically over the pivot pin 98, with one end of the spring 102 captured in a passage 104 in the side of the support member tube 12. The opposite end of the spring 102 is captured in a slot 106 formed in the opposite end of the pivot pin 98. The support tube 12 and balance spring 102 captured therein are retained upon the pivot pin 98 by a retaining washer 108 and cotter pin 110, or other suitable structure.

The balance spring 102 serves to counteract the weight of the opposite end 16 of the support tube 12 and its associated structure, which would otherwise bear down upon the golfer G due to the attachment of the waist support 26 about the golfer G. The spring 102 has a preload torsion applied thereto at the time of assembly of the present golfer support by winding the first clamp assembly 18 and attached pivot pin 98 relative to the support member tube 12. A bolt or stud 112 is then threaded into a nut 114 above the pivot pin 98 and support member tube 14, to prevent the first clamp assembly 18 from unwinding relative to the support member 12. Alternative limit means may be used if so desired, e.g., welding a limit stud permanently in place, etc. It should be noted that the bolt or stud 112 actually extends across the support member tube 12, but is shown shortened considerably in FIG. 3, for clarity in the drawing. The golfer support assembly 10 is then secured to the golf cart C structure, with motion of the first clamp assembly 18 relative to the support member 12 being limited by the limit bolt or stud 112. Once the first clamp 18 has been secured to the appropriate roof support upright, the weight and length of the support member 12 and extension tube 22 produce a moment which counterbalances the torque of the balance spring 102, with the distal end 24 of the extension tube 22 being essentially weightless due to the balance spring 102.

A telescoping extension arm 22 extends from the support tube 12, as noted further above. The captured end 116 of the extension arm 22 is illustrated in the broken away perspective view of FIG. 3, as well as in FIG. 4, where the extension arm 22 is shown in its extended position. The captured or proximal end 116 of the extension arm 22 includes a sleeve bearing 118 (plastic ring, etc.) installed thereon, which bears against the interior surface of the support tube 12. A second sleeve bearing 120 is installed about the extension arm tube 22 somewhat more toward the distal end 24 thereof, to support the extension arm 22 within the support member 12 and also to act in combination with an extension catch as a retainer to hold the extension arm 22 in its extended position.

Figure 4:
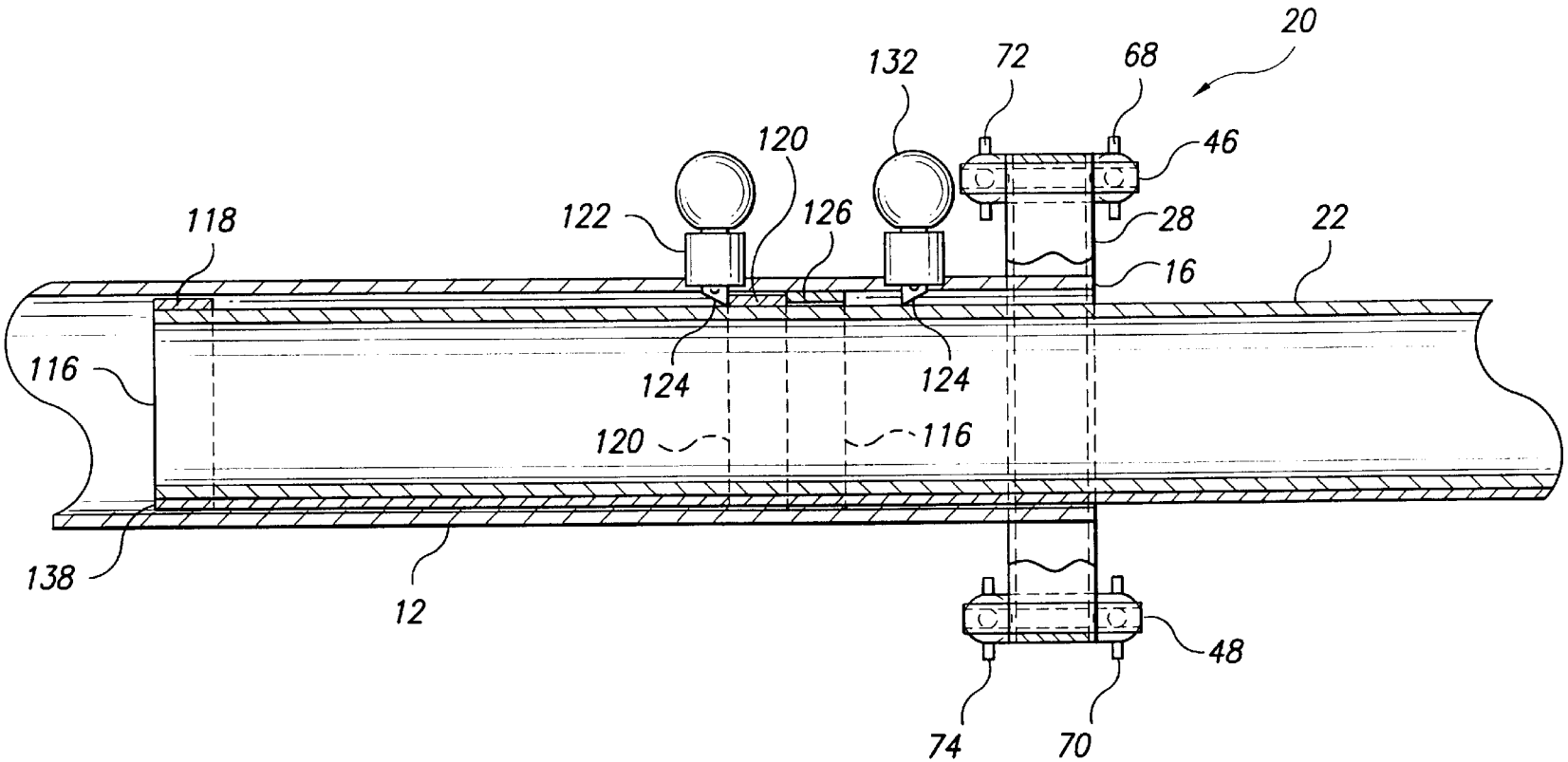
FIG. 4 is an elevation view in section of the latch end of the outer support tube and the retaining guard with the extension tube in an extended position, showing details thereof.

FIG. 4 illustrates this structure, with the extension arm 22 shown extended from the second end 16 of the support member 12. An extension latch assembly 122 extends from the top of the support member 12, with a latch bar 124 passing through the wall of the support member 12 to engage the inwardly oriented edge of the second sleeve bearing 120. An extension stop bearing 126 is affixed to the inner surface of the support tube 12, to prevent excessive extension of the extension arm 22. Due to the taper of the latch bar 124, the extension arm 22 may be pulled outwardly from the support member 12, with the retainer catch bearing sleeve 120 slipping beneath the tapered face of the latch bar 124 until the bar 124 clicks into place behind the sleeve 120 to hold the arm 22 in its extended position. Arm 22 retraction is achieved by lifting the latch bar 124 to allow the sleeve 120 to pass thereunder.

Figure 5:
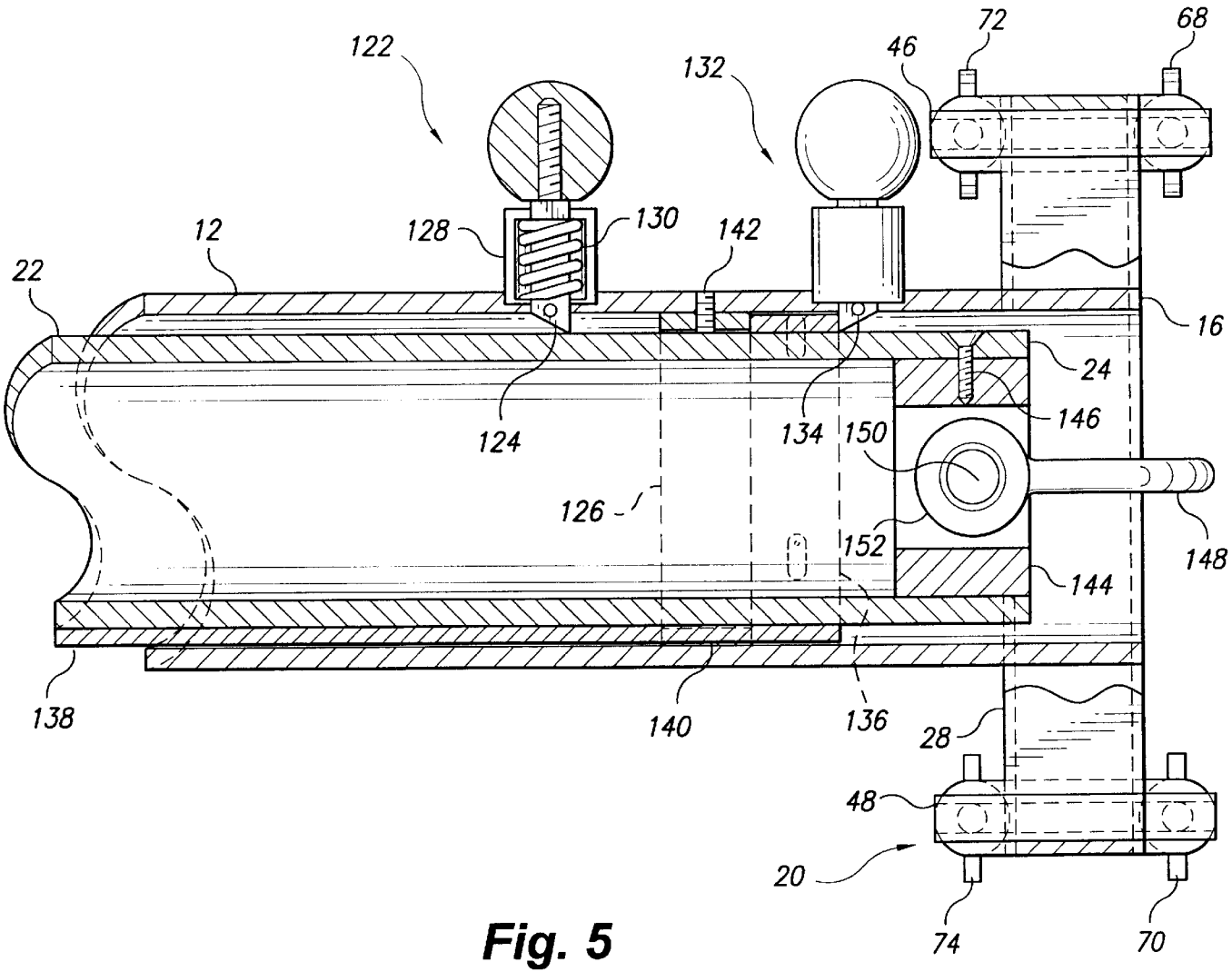
FIG. 5 is an elevation view in section of the latch end of the outer support tube and the retaining guard with the extension tube in a retracted position, showing details thereof.

FIG. 5 illustrates the second end 16 of the support member 12, as well as the distal end 24 of the extension arm 22 in its retracted position within the support member 12, and details of the extension latch assembly 122. The extension latch assembly 122 includes a body or housing 128, within which the latch bar 124 slides inwardly and outwardly. A compression spring 130 urges the bar 124 to its extended position, i. e., to engage the retainer catch sleeve bearing 120 when the extension arm 22 is extended to its maximum outwardly extended position or length, as was shown in FIG. 4 of the drawings.

A second retraction latch assembly 132 is provided outwardly (i. e., to the right, in FIGS. 4 and 5) from the extension latch assembly 122, with the latch bar 134 of the retraction latch assembly 132 engaging a retraction catch sleeve bearing 136 to hold the extension arm 22 in its fully retracted position until the latch bar 134 is withdrawn from its engagement with the sleeve 136. The two latch assemblies 122 and 132 are essentially identical, with the exception that the taper of the face of the latch bar 134 of the retraction latch assembly 132 is opposite that of the latch bar 124 of the extension latch assembly. This allows the retraction catch sleeve bearing 136 to slide past the latch bar 134 on retraction of the extension arm 22, but to hold the extension arm 22 in its fully retracted position until the latch bar 134 of the retraction latch assembly 132 is lifted from its engaged position, as shown in FIG. 5.

Preferably, some means is provided to preclude relative rotation between the inner extension arm 22 and its surrounding outer support member 12. This is accomplished by means of an elongate key 138 which is secured along one side (e. g., the lower surface) of the extension arm 22, between the extension arm 22 and the support member 12. The bearing sleeve 126 affixed within the outer support member 12 includes a slot 140 formed therein, through which the key 138 slides when the extension arm 22 is extended from and retracted within the outer support member 12. As the bearing sleeve 126 is immovably affixed relative to the support member 12, e. g. by means of a set screw 142, or alternatively adhesives, etc., and the key 138 is immovably affixed to the outer surface of the extension arm 22, the extension arm 22 is precluded from axial rotation relative to the support member tube 12.

FIG. 5 also illustrates details of the structure for removably securing a belt or other golfer support to the distal end 24 of the extension arm 22. An open plug 144 is secured in the distal end 24 of the extension arm 22, e. g. by screws 146, etc. The plug 144 has an open center, in which a hook 148 with a guarded throat is secured by means of a transverse pin or bolt 150 across the open plug 144 and through the attachment eye 152 of the hook 148. This hook 148 is used to secure the golfer support (belt 26, etc.) removably to the distal end 24 of the extension arm 12, as illustrated in FIG. 7 and discussed in detail further below.

FIG. 6 illustrates the arrangement for retaining or securing the second end 16 of the support member 12 to the second roof support upright U2 of the golf cart C. The basic components of the second clamp assembly 20 are identical to those of the first clamp assembly 18, and have been discussed in detail further above in the discussion of the clamp 18, 20 illustrated in FIG. 2. However, the clamp 20 assembly differs from the clamp 18 assembly in that the clamp 20 assembly secures the support member 12 by a surrounding retainer bracket or guard 154. This guard 154 includes opposite upper and lower attachment ends, respectively 156 and 158, which may be affixed (welded, etc.) to the respective upper and lower crossmembers 46 and 48, or directly to the first channel 28.

The retainer 154 has a vertical span 160 somewhat greater than the diameter 162 of the support member 12, surrounding the second end 16 of the support member 12 but also allowing a predetermined, limited amount of vertical arcuate motion or play. This allows for some movement and variation in height for a golfer(s) G using the support, as well as accommodating slight variations in terrain between the golf cart C and the position of the golfer G. The pivotal attachment of the first end 14 of the support member 12 allows the member 12 to move arcuately within the guard 154, with the balance spring 102 essentially neutralizing the weight of the support member 12 and included extension member 22, particularly when the extension member 22 is extended. Other weight compensation means may be provided, e.g., a spring(s) or resilient material between the guard 154 and support member 12, etc.

Figure 7:
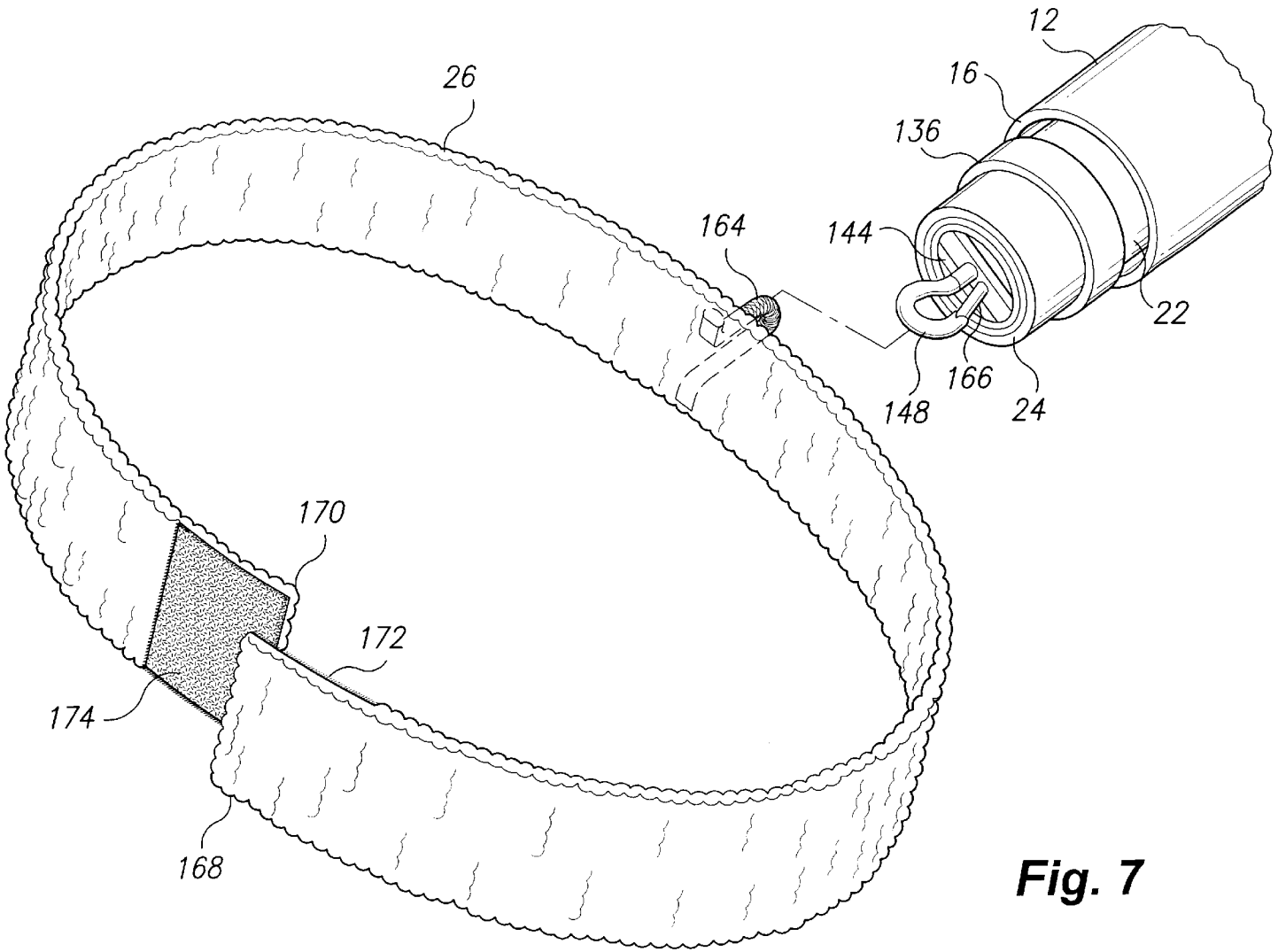
FIG. 7 is an exploded perspective view of the distal end of the support tube assembly and support belt, showing the removable attachment of the belt to the end of the extension tube.

FIG. 7 illustrates the removable attachment of the golfer support belt 26 to the distal end 24 of the extension arm 22. The belt 26 is preferably padded, and may be formed from a conventional support belt such as manufactured by American Work Products, Inc. The belt 26 includes an attachment loop 164 of sturdy webbing or other suitable material extending from the back surface thereof, for removably securing the belt 26 to the spring latch hook 148 installed in the distal end 24 of the arm 22. The catch 166 across the throat of the hook 148 is pushed open to install the belt loop 164 therein, or to remove the belt loop 164 therefrom, as desired.

The belt 26 includes opposite first and second ends, respectively 168 and 170, with the two ends 168 and 170 each having a mating area of hook and loop fastener material, respectively 172 and 174, disposed thereon. Other belt end attachment means may be provided as desired, e. g., snaps, buckles, etc., but such mating hook and loop material has been found to be the most convenient means for quickly and easily securing and releasing the belt 26 about the waist of the golfer G. It will be seen that such a belt 26 is not an absolute requirement for the present disabled golfer support, and that other support attachments may be provided as desired. For example, the spring latch hook 148 may be secured directly to a conventional belt or belt loop of the trousers being worn by the golfer, if so desired. However, the present belt 26 has been found to be a most convenient and comfortable support means. The critical point is that the support means be passive, and not require the active use of the golfer's hands for support.

In conclusion, the present support for a disabled golfer provides a much appreciated means for a golfing enthusiast to continue playing the game after suffering some physical infirmity which would otherwise affect his or her ability to play. The present support enables the golfer who has difficulty in standing or maintaining balance, to position himself or herself to make a golf stroke without fear of falling.

The present disabled golfer's support is relatively lightweight due to the materials used in its design, but provides sufficient strength to support the golfer with confidence. The light weight of the present support enables the golfer to carry the device easily along with his or her clubs, and to install the device across the roof support members of a rented golf cart for a round of golf. Alternatively, a golf operation may equip one or more of its carts with the present supports, where they will be available to physically disabled golfers at any time.

The present support is easily installed, merely by positioning the two clamps around the appropriate roof support members of the golf cart and securing the wing nuts or other fasteners as required. The preferred wing nuts do not require any form of tools or other equipment for installation or removal. The limit bolt or stud may be left in place in the nut, as noted further above, as the motion of the support member is limited by the retaining bracket once the assembly has been installed.

The golfer using a golf cart equipped with the present support, need only position the cart with the support member generally aligned with the position of the ball, and a few feet from the ball. The golfer then selects the club to be used and leaves the cart, perhaps using the present support for assistance as required while extending the extension arm. The extension arm is locked into position by means of the appropriate latch, and the golfer secures himself or herself by means of the belt or other passive support element. This leaves the golfer's hands and arms free to swing the club without fear of falling.

When the golf stroke has been completed, the procedure is quickly and easily reversed, with the golfer removing the belt, retracting the extension arm by releasing the appropriate latch, and returning to the cart to travel to the next position of the ball for the next stroke. When the round of golf is completed, the golfer may remove his or her support from the cart (for a golfer owned support), merely by loosening the wing nuts to allow the two clamps to be removed from their respective roof supports of the golf cart. The limit bolt or stud remains in place to preclude unwinding of the first clamp relative to the support tube, once the assembly has been removed from the golf cart. The support may then be transported as desired with the golfer's remaining equipment (clubs, etc.) until needed for another round of golf. Thus, the present disabled golfer's support will find great favor among those who love the game, but have been unable to enjoy it due to various physical disabilities.

It is to be understood that the present invention is not limited to the embodiment described above, but encompasses any and all embodiments within the scope of the following claims.

I claim:

1. A support for removable attachment to a conventional golf cart having a plurality of roof support uprights and for supporting a disabled golfer thereby, comprising:

a rigid, elongate support member having a first end and a second end opposite said first end;

a first roof support clamp secured to said first end of said support member, and a second roof support clamp secured to said second end of said support member;

a rigid, cantilever extension arm extending from said support member, and having a distal golfer support end opposite said support member; and a passive golfer support extending from said golfer support end of said extension arm.

2. The disabled golfer support according to claim 1, wherein:

said support member comprises a hollow tube; and said extension arm is telescopically disposed within said support member, for adjustably extending therefrom.

3. The disabled golfer support according to claim 2, further including an extension latch and a retraction latch disposed upon said support member, for selectively securing said extension arm.

4. The disabled golfer support according to claim 2, further including:

at least one bearing sleeve disposed within said support member and supporting said extension arm therein, said at least one bearing sleeve further including a slot formed therein; and an elongate key disposed along said extension arm and passing through said slot of said at least one bearing sleeve, for precluding axial rotation of said extension arm within said support member.

5. The disabled golfer support according to claim 1, wherein said passive golfer support comprises a waist belt adjustably and removably securable about the waist of the golfer.

6. The disabled golfer support according to claim 1, further including:

a pivot pin extending from said first clamp and pivotally securing said first end of said support member thereto;

a retainer guard extending from said second clamp, surrounding said second end of said support member and securing said second end of said support member therein;

said support member having a diameter; and said retainer guard having a vertical span greater than said diameter of said support member, for limiting arcuate movement of said support member within said vertical span of said retainer guard.

7. The disabled golfer support according to claim 1, wherein each said roof support clamp comprises:

a first channel and a second channel;

each said channel having a first end, a second end opposite said first end, and mutually facing interior portions adapted for removable attachment about one of the roof support uprights of the golf cart;

a first and a second crossmember secured laterally across each respective said end of said first channel, each said crossmember having a first end and a second end opposite said first end;

an externally threaded fastener pivotally secured to and extending from each said end of each said crossmember;

an internally threaded nut cooperatingly threaded to and inescapably captured upon a corresponding said externally threaded fastener;

a first and a second fastener attachment plate secured laterally across each respective said end of said second channel, each said fastener attachment plate having a first end and a second end opposite the first end, the first end of each said fastener attachment plate further including a fastener passage therethrough and permanently capturing one said externally threaded fastener therein; and the second end of each said fastener attachment plate further including a fastener slot therein for removably capturing one said externally threaded fastener therein.

8. A support for removable attachment to a conventional golf cart having a plurality of roof support uprights and for supporting a disabled golfer thereby, comprising:

a rigid, elongate hollow tube support member having a first attachment point and a second attachment point opposite said first attachment point;

a first roof support clamp extending from said first attachment point of said support member, and a second roof support clamp extending from said second attachment point of said support member;

a rigid, cantilever extension arm telescopically disposed within said support member and adjustably extending therefrom, and having a distal golfer support end opposite said support member; and a passive golfer support extending from said golfer support end of said extension arm.

9. The disabled golfer support according to claim 8, further including an extension latch and a retraction latch disposed upon said support member, for selectively securing said extension arm.

10. The disabled golfer support according to claim 8, further including:

at least one bearing sleeve disposed within said support member and supporting said extension arm therein, said at least one bearing sleeve further including a slot formed therein; and an elongate key disposed along said extension arm and passing through said slot of said at least one bearing sleeve, for precluding axial rotation of said extension arm within said support member.

11. The disabled golfer support according to claim 8, wherein said passive golfer support comprises a waist belt adjustably and removably securable about the waist of the golfer.

12. The disabled golfer support according to claim 8, further including:

a pivot pin extending from said first clamp and pivotally securing said first end of said support member thereto;

a retainer guard extending from said second clamp, surrounding said second end of said support member and securing said second end of said support member therein;

said support member having a diameter; and said retainer guard having a vertical span greater than said diameter of said support member, for limiting arcuate movement of said support member within said vertical span of said retainer guard.

13. The disabled golfer support according to claim 8, wherein each said roof support clamp comprises:

a first channel and a second channel, each said channel having a first end, a second end opposite said first end, and mutually facing interior portions adapted for removable attachment about one of the roof support uprights of the golf cart;

a first and a second crossmember secured laterally across each respective said end of said first channel, each said crossmember having a first end and a second end opposite said first end;

an externally threaded fastener pivotally secured to and extending from each said end of each said crossmember;

an internally threaded nut cooperatingly threaded to and inescapably captured upon a corresponding said externally threaded fastener;

a first and a second fastener attachment plate secured laterally across each respective said end of said second channel, each said fastener attachment plate having a first end and a second end opposite said first end;

said first end of each said fastener attachment plate further including a fastener passage therethrough and permanently capturing one said externally threaded fastener therein; and said second end of each said fastener attachment plate further including a fastener slot therein for removably capturing one said externally threaded fastener therein.

14. A support for removable attachment to a conventional golf cart having a plurality of roof support uprights and for supporting a disabled golfer thereby, comprising:

a rigid, elongate support member having a first attachment point and a second attachment point opposite said first attachment point;

a first roof support clamp extending from said first attachment point of said support member, and a second roof support clamp extending from said second attachment point of said support member;

a rigid, cantilever extension arm extending from said support member, and having a distal golfer support end opposite said support member; and a waist belt adjustably and removably securable about the waist of the golfer, extending from said golfer support end of said extension arm.

15. The disabled golfer support according to claim 14, wherein:

said support member comprises a hollow tube; and said extension arm is telescopically disposed within said support member, for adjustably extending therefrom.

16. The disabled golfer support according to claim 15, further including an extension latch and a retraction latch disposed upon said support member, for selectively securing said extension arm.

17. The disabled golfer support according to claim 15, further including:

at least one bearing sleeve disposed within said support member and supporting said extension arm therein, said at least one bearing sleeve further including a slot formed therein; and an elongate key disposed along said extension arm and passing through said slot of said at least one bearing sleeve, for precluding axial rotation of said extension arm within said support member.

18. The disabled golfer support according to claim 14, further including:

a pivot pin extending from said first clamp and pivotally securing said first end of said support member thereto;

a retainer guard extending from said second clamp, surrounding said second end of said support member and securing said second end of said support member therein;

said support member having a diameter; and said retainer guard having a vertical span greater than said diameter of said support member, for limiting arcuate movement of said support member within said vertical span of said retainer guard.

19. The disabled golfer support according to claim 14, wherein each said roof support clamp comprises:

a first channel and a second channel, each said channel having a first end, a second end opposite said first end, and mutually facing interior portions for removably securing about one of the roof support uprights of the golf cart;

a first and a second crossmember secured laterally across each respective said end of said first channel, each said crossmember having a first end and a second end opposite said first end;

an externally threaded fastener pivotally secured to and extending from each said end of each said crossmember;

an internally threaded nut cooperatingly threaded to and inescapably captured upon a corresponding said externally threaded fastener;

a first and a second fastener attachment plate secured laterally across each respective said end of said second channel, each said fastener attachment plate having a first end and a second end opposite said first end;

said first end of each said fastener attachment plate further including a fastener passage therethrough and permanently capturing one said externally threaded fastener therein; and said second end of each said fastener attachment plate further including a fastener slot therein for removably capturing one said externally threaded fastener therein.

* * * * *